United States Patent [19]

Cordry et al.

[11] Patent Number: 4,687,206

[45] Date of Patent: Aug. 18, 1987

[54] GLOBAL DOMINATION BOARD GAME

[75] Inventors: Christopher D. Cordry; Stephen T. Weeks, both of Oklahoma City, Okla.

[73] Assignee: New Earth Games, Oklahoma City, Okla.

[21] Appl. No.: 686,307

[22] Filed: Dec. 24, 1984

[51] Int. Cl.[4] ..... A63F 3/00

[52] U.S. Cl. ..... 273/262

[58] Field of Search ..... 273/146, 255, 262

[56] References Cited

U.S. PATENT DOCUMENTS

| | | | |
|---|---|---|---|
| D. 233,463 | 10/1974 | Roger . | |
| 1,523,615 | 1/1925 | Stern | 273/146 |
| 1,666,953 | 4/1928 | Tuttle et al. . | |
| 2,199,731 | 4/1919 | Ireland . | |
| 2,273,292 | 2/1942 | Smith | 273/255 |
| 2,329,500 | 9/1943 | Williams . | |
| 3,756,604 | 9/1973 | Laszlo . | |
| 3,951,410 | 4/1976 | McNeil . | |
| 4,093,236 | 6/1978 | Hoffa . | |
| 4,221,389 | 9/1980 | Read . | |
| 4,239,229 | 12/1980 | Crossley | 273/255 |

FOREIGN PATENT DOCUMENTS

| | | | |
|---|---|---|---|
| 2081109 | 2/1982 | United Kingdom | 273/255 |

OTHER PUBLICATIONS

Rules for the game of Risk®—Rules ©1959, 1963, 1975, 1980 Parker Brothers, Beverly, MA 01915.

"Global War"; Simulations Publications, pp. 1–16, copyright 1975.

"1776", Avalon Hill Game Company, pp. 1–7, copyright 1974.

Rules of Play, "World War III", copyright 1975, Simulations Publications, Inc.

*Primary Examiner*—Richard C. Pinkham

*Assistant Examiner*—Matthew L. Schneider

*Attorney, Agent, or Firm*—Laney, Dougherty, Hessin & Beavers

[57] ABSTRACT

A global domination board game for a plurality of players having the object of total global domination by one of the players without excessive destruction of the planet. A game board has a map of a planetary surface divided into a plurality of continental powers, and further divided into a plurality of territories within each continental power. Each territory is identified as having a primary asset including population, resources or technology. A deck of cards is used which includes a territory card for each of the territories identified on the map of the game board and a plurality of wild cards. Players have a plurality of active playing pieces including pieces representing conventional forces, tactical weapon systems and strategic nuclear weapons. Players conduct simulated military attacks on territories occupied by opposing players. In an alternate embodiment, players also have naval capability, and it is possible for all players to lose the game if destruction of the planetary surface exceeds a predetermined level.

20 Claims, 15 Drawing Figures

COUNT DOWN 10.2

| | | | | |
|---|---|---|---|---|
| START | 1945 / 1960 | 1961 / 1976 | 1977 / 1982 | 1983 / 1988 |
| 1989 / 1993 | JAN/JUL 1994 | AUG / 1 / 1994 | AUG 2 | AUG 3 |
| AUG / 4 / AM | 12:00 noon | 1:00 PM | 1:30 PM | 2:00 PM |
| 2:15 PM | 2:30 PM | 2:45 PM | 3:00 PM | END |

RESULTS 10.3

| CLASS VICTORY | TERRITORIES —NUKED— | DAMAGE LEVELS |
|---|---|---|
| 1 | 1 — 10 | LIGHT |
| 2 | 11 — 20 | MEDIUM |
| 3 | 21 — 30 | HEAVY |
| 4 | 31 — 35 | CRITICAL |
| 0 | 36 — 48 | TOTAL |

WORLD POWER STRUCTURE 2.1

| Continental Power | NORTH AMERICA | EUROPE | AFRICA | FAR EAST |
|---|---|---|---|---|
| territories | 8 | 6 | 6 | 6 |
| reinforcements | 6 | 5 | 4 | 5 |
| Continental Power | WEST PACIFIC | SOUTH AMERICA | MIDDLE EAST | U.S.S.R. |
| territories | 5 | 5 | 4 | 8 |
| reinforcements | 4 | 4 | 4 | 6 |

4.0 POWER CARD
T TECHNOLOGY
R RESOURCE
P POPULATION

GLOBAL DOMINATION BOARD GAME

BACKGROUND OF THE INVENTION

1. Field of the Invention

This invention relates to board games wherein players attempt to achieve global domination by a series of simulated military attacks between territories on a map, and particularly to a game in which said attacks may be carried out by conventional forces, tactical weapons and strategic nuclear weapons.

2. Description of the Prior Art

The prior art related to global domination board games generally incorporates simulated conventional military attacks of limited scope, and thus are lacking in realism when compared to the weapons capabilities of the major world powers of today. Also, none of the games in the prior art simulate the combinations of population, resources and technology which are necessary to produce nuclear weapons systems and which distinquish the major world powers. For example, U.S. Pat. No. 3,951,410 to McNeil discloses a war-type board game simulating the War of the Roses fought in fifeenth century England. Player piece movement and the outcome of simulated battles are primarily determined by drawing individual cards from two packs.

In U.S. Pat. No. 1,299,731 to Ireland, player pieces are moved on a may which shows a portion of the surface of the planet Earth with emphasis on Europe and western Asia. The map has a grid overlaying it, and player pieces are moved along the grid with movement being similar to that of checkers. No attempt is made to actually simulate battles between the various national powers, and no provisions are made for weapons of varying strength. There are no playing cards used in the game.

U.S. Pat. No. 2,273,292 to Smith relates to a board game in which the object of the game is to conquer all other countries of the world. The game board comprises a map showing an equatorial projection of the planet Earth with a grid overlaying it and a circular track therearound. Various countries are identified, and each country has an arbitrary value in money and a military power value assigned to it. The circular track around the map is divided into segments having various instructions relating to expenditures of money and losses or gains of military power. A world bank is a depository for all money transactions. The outcomes of simulated battles are determined by comparing the relative values of money and military power. No playing pieces are actually laid on the map except for flags indicating control of various areas.

Another board game is "Risk" manufactured by Parker Brothers which has a game board with an equatorial projection of planet Earth thereon showing the continents divided into a plurality of territories. The object of the game is to conquer and control all territories by simulated battles between armies of adjacent territories. No provision is made for attacking and conquering non-adjacent territories or for weapons of varying strength. The outcome of the simulated military battles is determined by comparing the roll of dice by the player of the attacking country and the player of the attacked country. According to the instructions in "Risk", the game is based on an old French game.

U.S. Pat. No. 2,756,604 to Laszlo is one game which provides for nuclear weapons. However, player movement is limited to rolling dice and moving around a circular track. No attempt is made to simulate actual military movement on a planetary surface. The timing and outcome of military battles is primarily determined by playing cards.

SUMMARY OF THE INVENTION

The board game of the present invention is intended for use by a plurality of players, and comprises a game board, a plurality of playing pieces, a deck of playing cards and chance means.

The game board includes a map depicting a planetary surface, which in the preferred embodiment is Earth. The planetary surface comprises a plurality of geographical areas, or continental powers, thereon, and each of the geographical areas is divided into a plurality of geographical subdivisions or territories. Asset indicia are placed on each territory on the map as an indication of a primary asset thereof. The assets used in the preferred embodiment are population, resources and technology. A border surrounds the central map portion, and the border includes a plurality of play action indicia which indicate various play action, and results thereof, folllowed by players during the game.

The deck of playing cards includes an individual geographical subdivision or territory card for each of the territories depicted on the map of the game board. Also included in the deck of cards are a plurality of power, or "wild", cards substitutable for any geographical subdivision card.

The playing pieces include active playing pieces which comprise military capability indicia for indicating one of a plurality of types of military capability and a relative strength thereof, and a plurality of passive playing pieces. The active playing pieces are placeable and movable, individually and in combination, on the game board for indicating respective control of the territories on the map, and are used for simulating military attacks between territories controlled by opposing players. The military capability indicia comprise conventional forces, tactical weapons systems and strategic nuclear weapons. The conventional force playing pieces may be used to attack adjacent territories, the tactical weapon system playing pieces may be used to attack adjacent territories and also non-adjacent intracontinental territories, and the strategic nuclear weapon playing pieces are intercontinental and may be used to attack territories at any location on the map. The passive playing pieces are in the form of a total destruction marker or radiation token which is placed on a territory which has been destroyed by a simulated attack by a strategic nuclear weapon playing piece. These passive playing pieces are not moved for the remainder of the game.

An important object of the present invention is to provide a global domination board game which is realistic and recognizes the military and weapons capabilities of modern-day world powers.

Another object of the invention is to provide a global domination board game in which players have playing pieces representing conventional forces, intracontinental tactical weapon systems and intercontinental strategic nuclear weapons.

An additional object of the invention is to provide a global domination board game in which the military capability of the players is determined by combinations of assets, including population, resources and technology.

Still another object of the invention is to provide a global domination board game in which players have naval military capability as well as land-based military capability.

A further object of the invention is to provide a global domination board game in which all players may lose if destruction to a planetary surface exceeds a predetermined level.

Additional objects and advantages of the invention will become apparent as the following detailed description of the preferred embodiment is read in conjunction with the accompanying drawings which illustrate such preferred embodiment.

DETAILED DESCRIPTION OF THE PREFERRED EMBODIMENT

Figure 1:
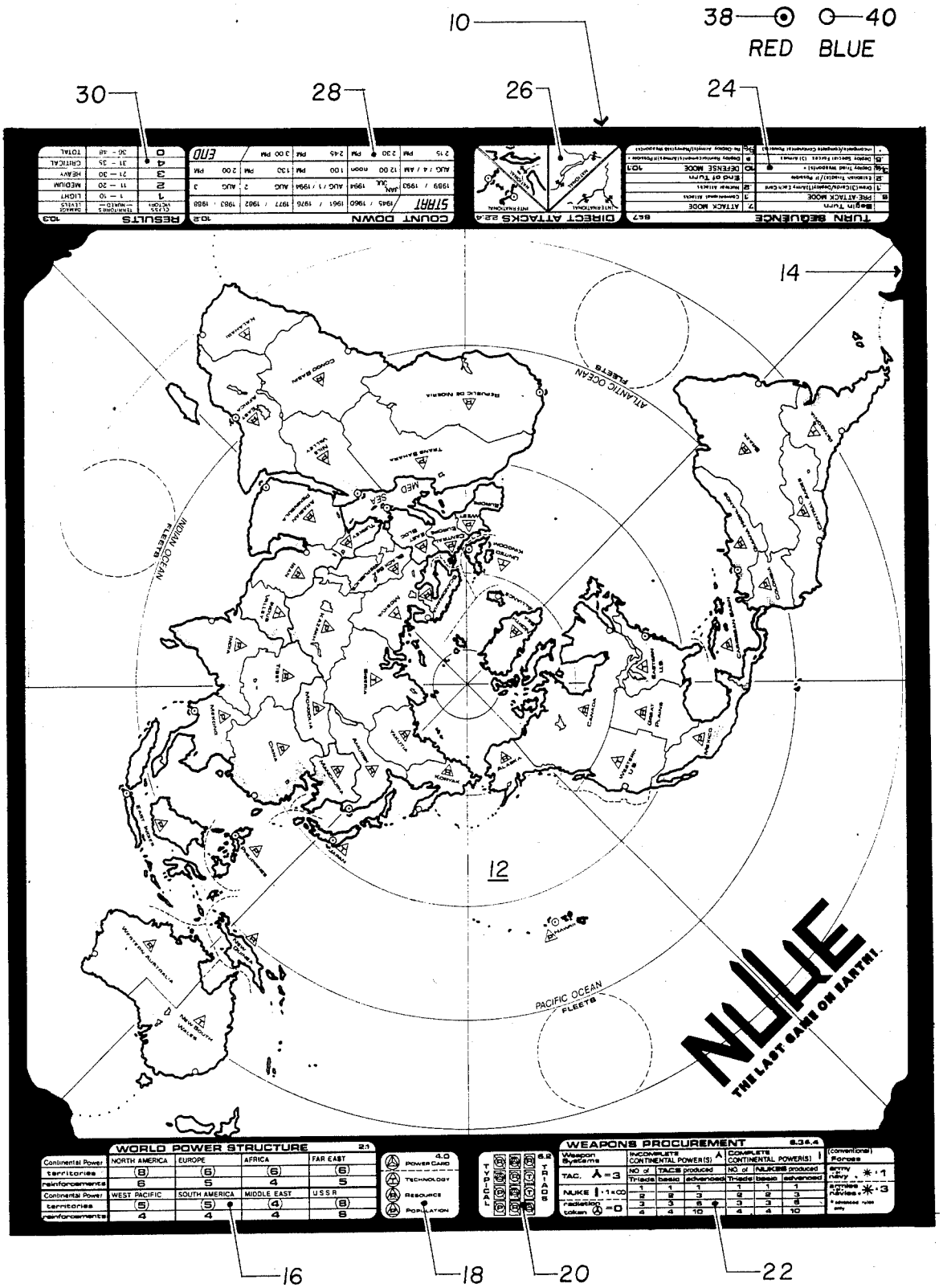
FIG. 1 shows the surface of the game board utilized in the global domination board game of the present invention with color coding indicated adjacent thereto.
Figure 2:
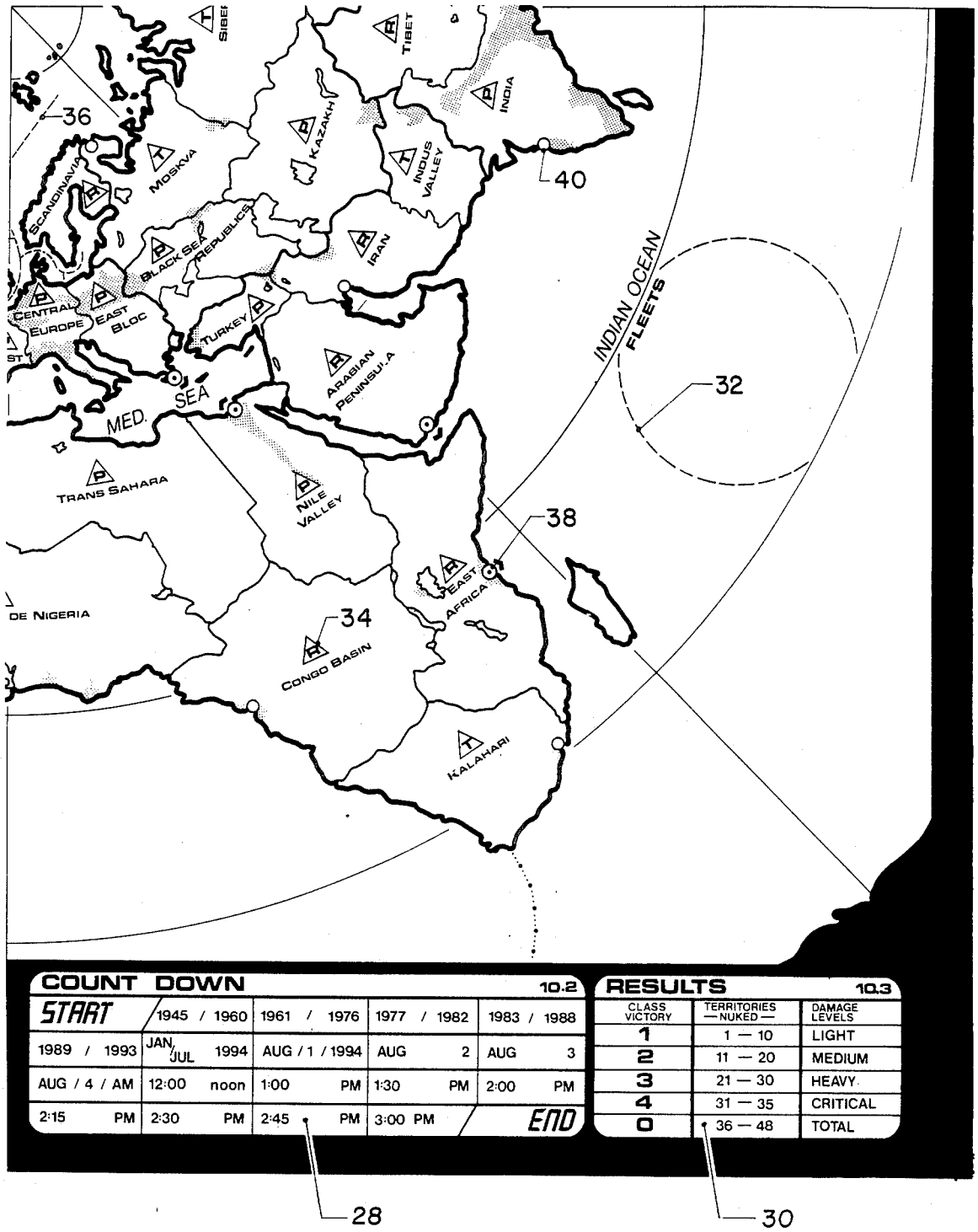
FIG. 2 is a detail of the upper left quadrant of the game board viewed from the top of FIG. 1.
Figure 3:
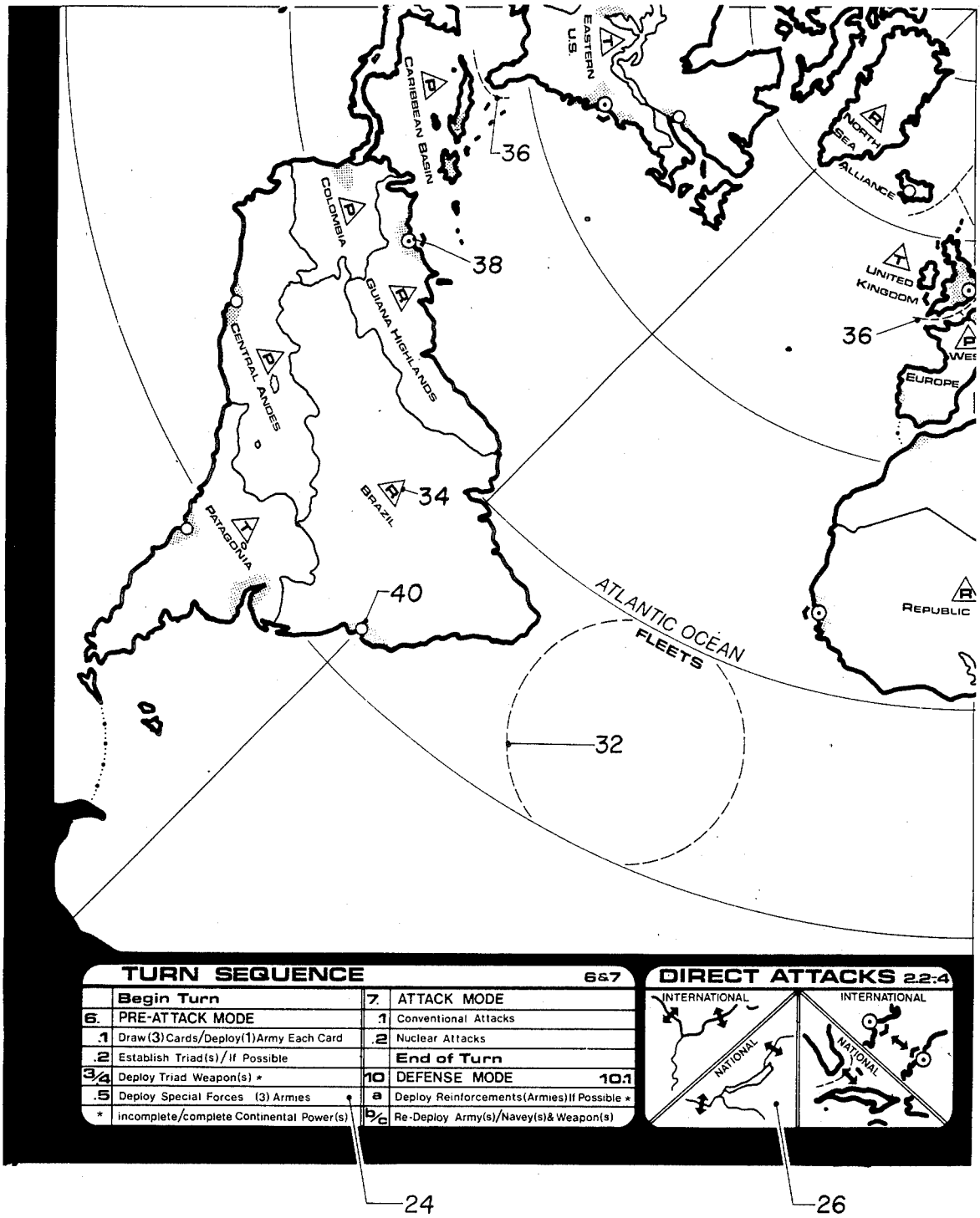
FIG. 3 is a detail of the upper right quadrant of the game board viewed from the top of FIG. 1.
Figure 4:
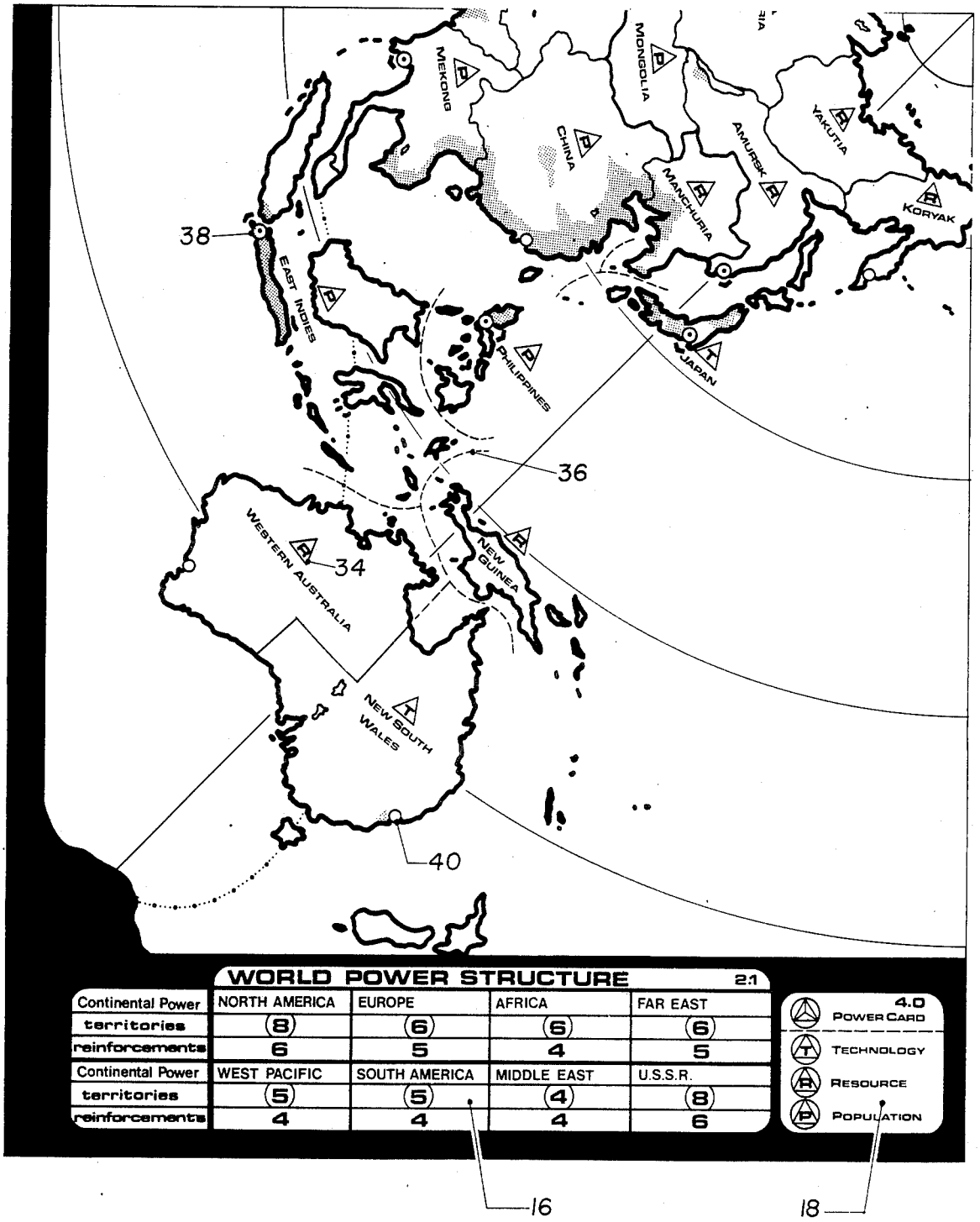
FIG. 4 is a detail of the lower left quadrant of the game board viewed from the bottom of FIG. 1.
Figure 5:
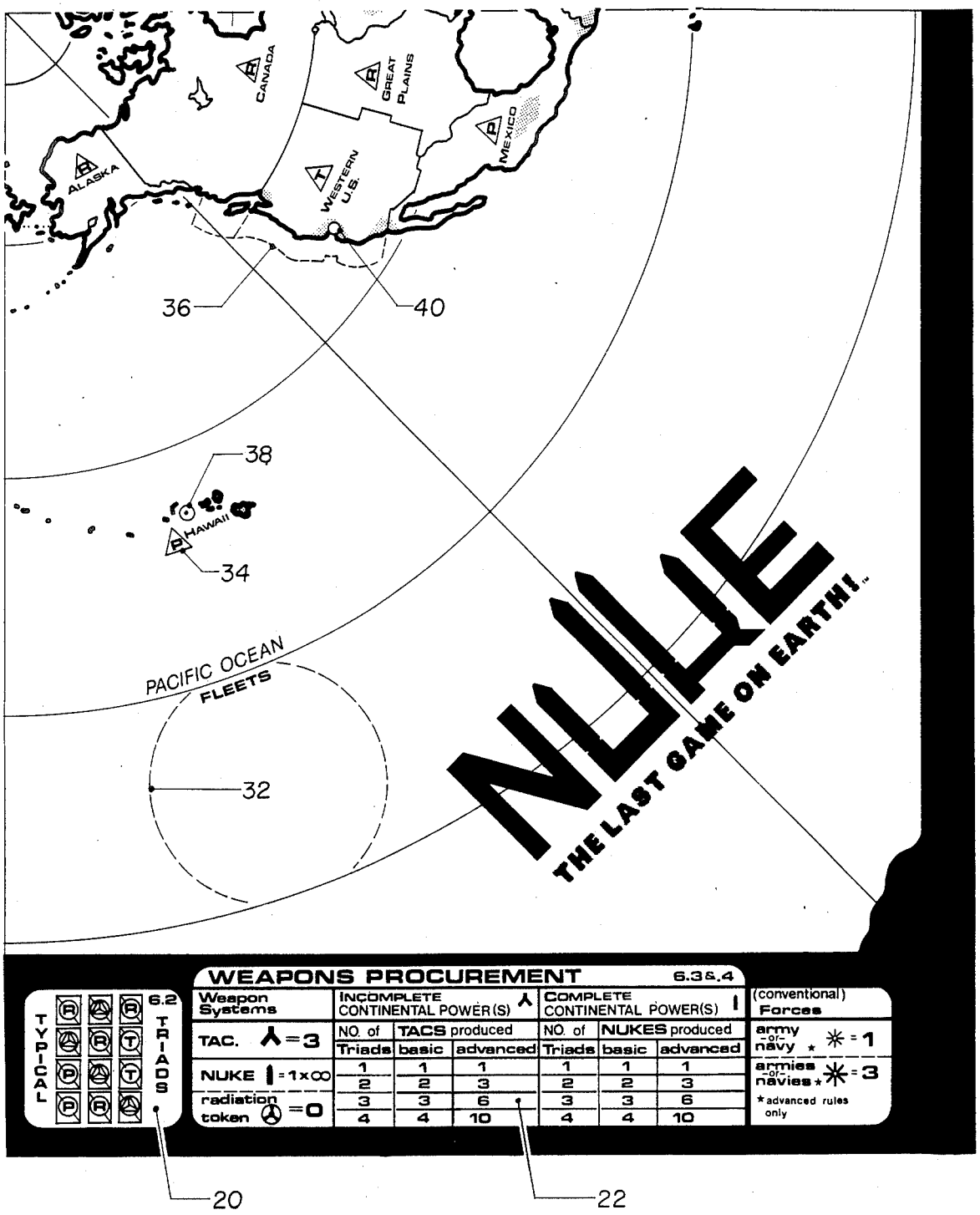
FIG. 5 is a detail of the lower right quadrant of the game board viewed from the bottom of FIG. 1.

Referring now to the drawings, and particularly to FIG. 1, a game board utilized in playing the global domination board game of the present invention is shown and generally designated by the numeral 10. Game board 10 has a central map portion 12 with a surrounding border 14. Various play action indicia are printed on the playing board, forming a part of border 14, said play action indicia including a world power structure table 16, an asset identification table 18, a playing card combination table 20, a weapons procurement chart 22, a turn sequence table 24, a detail map 26 showing lines of simulated military attack between adjacent territories, a countdown time table 28 and a results chart 30 indicating classes of victory depending upon damage incurred in the simulated attacks. In the embodiment shown in FIG. 1, central map portion 12 depicts a northern polar projection of planet Earth showing a plurality of continental powers thereon. Each continental power is identified by a unique color and is divided into a plurality of territories. Although the preferred embodiment shows the planet Earth, it is not limited to such a configuration. Any map showing a plurality of geographical areas divided into geographical subdivisions could be utilized.

Referring now to the detailed maps of FIGS. 2–5, the various continental powers and territorial subdivisions thereof are shown. In addition, the Atlantic Ocean, Indian Ocean, Pacific Ocean and Mediterranean Sea are identified. In the Atlantic, Indian and Pacific Oceans, naval fleet deployment areas 32 are shown by substantially circular dashed lines, the purpose of which is hereinafter discussed.

Each territory in FIGS. 1–5 has an asset indicia 34 indicated thereon in the form of a triangle enclosing one of the letters P, R or T as an abbreviation for population, resources of technology, respectively. These asset indicia indicate that each territory has a primary asset, and combinations of these assets are utilized in determining military capability and types of weapons available as hereinafter described.

In the preferred embodiment representing planet Earth, but not by way of limitation, the various continental powers, as well as the territorial subdivisions thereof and respective primary assets are identified as follows:

North America

Alaska—resources
Canada—resources
Western U.S.—technology
Great Plains—resources
Eastern U.S.—technology
Mexico—population
Caribbean Basin—population
Hawaii—population South America Colombia—population
Guiana Highlands—resources
Central Andes—population
Brazil—resources
Patagonia—technology Europe North Sea Alliance—resources
United Kingdom—technology
West Europe—population
Scandinavia—resources
Central Europe—population
East Bloc—population Africa Trans Sahara—population
Republic de Nigeria—resources
Nile Valley—population
Congo Basin—resources
East Africa—resources
Kalahari—technology

USSR

Moskva—technology
Black Sea Republics—population
Kazakh—population
Siberia—technology
Mongolia—population Yakutia—resources
Amursk—resources
Koryak—resources Middle East Turkey—population
Arabian Peninsula—resources
Iran—resources
Indus Valley—technology Far East India—population
Tibet—resources
China—population
Manchuria—resources
Mekong—population
Japan—technology West Pacific Philippines—population
East Indies—population
New Guinea—resources
Western Australia—resources
New South Wales—technology It should be noted that each continental power has at least one territory representing each of the three assets of population, resources or technology. A study of FIGS. 1-5 and the above list will show that in the preferred embodiment there are nineteen territories having population as the primary asset, nineteen territories in which resources are the primary asset and ten territories in which technology is the primary asset. These assigned assets and the numerical distribution thereof are arbitrary, and the invention is not intended to be so limited.

Throughout the playing of the game, simulated military attacks take place between territories occupied and controlled by opposing players, as will be described in more detail hereinafter. In many of these simulated battles, a territory may attack only adjacent territories. Terrotories are determined to be adjacent in three ways. The first, and most obvious, occurs when two territories have a common border and are thus actually adjacent. Territories in the same continental power, but divided by bodies of water present a differnet situation. In the preferred embodiment, certain of such territories are defined adjacent other specified territories in the same continental power for the purposes of attacks therebetween. As shown in the detail maps of FIGS. 2-5, a plurality of dashed lines 36 function as constructive borders between such adjacent intracontinental territories. In the preferred embodiment, but not by way of limitation, the territories affected are as follows:

Hawaii—defined adjacent Canada and Western U.S.
Caribbean Basin—defined adjacent Eastern U.S.
North Sea Alliance—defined adjacent United Kingdom and Scandinavia.
United Kingdom—defined adjacent North Sea Alliance, Scandinavia, Central Europe and West Europe.
Scandinavia—defined adjacent North Sea Alliance, United Kingdom, Central Europe and East Bloc.
Japan—defined adjacent Manchuria and China.
Philippines—defined adjacent East Indies.
East Indies—defined adjacent Philippines, New Guinea and Western Australia.
New Guinea—defined adjacent East Indies, Western Australia and New South Wales.

A third method is used for defining adjacent territories in different continental powers separated by oceans and seas. In this situation, a single territory in each continental power is defined adjacent one territory in each of the other continental powers which border the same ocean or sea. Such territories are identified by a red dot 38 on central map portion 12 of the actual game board 10. As shown in FIGS. 1-5, red dots 38 are indicated by a circle with a solid dot therein. In the preferred embodiment, but not by way of limitation, the adjacent intercontinental territories in the respective oceans or seas are:

Atlantic Ocean—Eastern U.S., Guiana Highlands, Republic de Nigeria and United Kingdom are all defined adjacent one another.
Indian Ocean—East Africa, Arabian Peninsula, Mekong and East Indies are all defined adjacent one another.
Pacific Ocean—Philippines, Japan, Amursk and Hawaii are all defined adjacent one another.
Mediterranean Sea—East Bloc and Nile Valley are defined adjacent one another.

Also, for purposes of naval attacks, certain territories are defined to be adjacent fleet deployment areas 32 in the Atlantic, Indian and Pacific Oceans. Thus, such territories act as simulated naval bases. All territories identified by a red dot 38 are defined as naval bases, and, in addition, some other territories, identified by a blue dot 40 on actual game board 10, also act as naval bases. In FIGS. 1-5, blue dots 40 are indicated by an empty circle slightly smaller than red dots 38. In the preferred embodiment, but not by way of limitation, the following territories are identified as naval bases and may attack, or be attacked by, the respective fleet deployment area 32:

Atlantic Ocean—Canada, Eastern U.S., Guiana Highlands, Brazil, North Sea Alliance, Moskva, United Kingdom, Republic de Nigeria and Congo Basin are defined as naval bases.
Indian Ocean—Arabian Peninsula, East Africa, Kalahari, Iran, India, Mekong, East Indies and Western Australia are defined as naval bases.
Pacific Ocean—Philippines, New South Wales, China, Japan, Amursk, Koryak, Hawaii, Western U.S., Central Andes and Patagonia are defined as naval bases.

Figure 6:
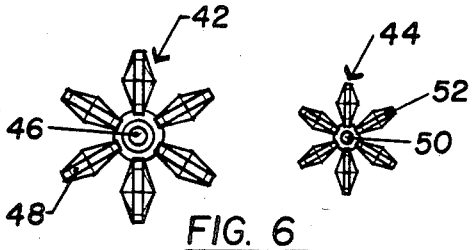
FIG. 6 is a plan view of playing pieces representing conventional military forces.
Figure 7:
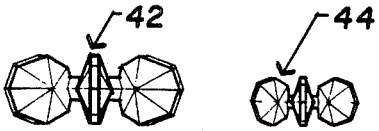
FIG. 7 is a side elevation view of the playing pieces shown in FIG. 6.

Referring now to FIGS. 6 and 7, playing pieces representing conventional military forces are shown and generally designated by the numerals 42 and 44. Conventional force playing piece 42 has a central hub 46 with a plurality of radial extensions 48 extending therefrom. Playing piece 44 has a similar central hub 50 with a plurality of radial extensions 52 extending therefrom. Basically, playing pieces 42 and 44 are identical except for size. In the preferred embodiment, but not by way of limitation, small playing piece 44 represents one conventional military force or "army", and larger playing piece 42 represents three conventional military forces of "armies".

Figure 8:
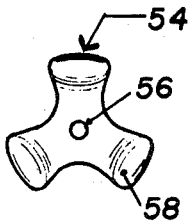
FIG. 8 is a plan view of a playing piece utilized in the board game of the present invention representing a tactical weapons system.
Figure 9:
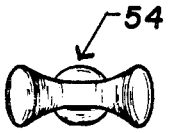
FIG. 9 is a side elevation view of the playing piece of FIG. 8.

Referring to FIGS. 8 and 9, a playing piece, generally designated by the numeral 54, is shown which represents a tactical weapons system. Playing piece 54 has a central portion 56 with three curvilinear spokes 58 extending radially therefrom.

Figure 10:
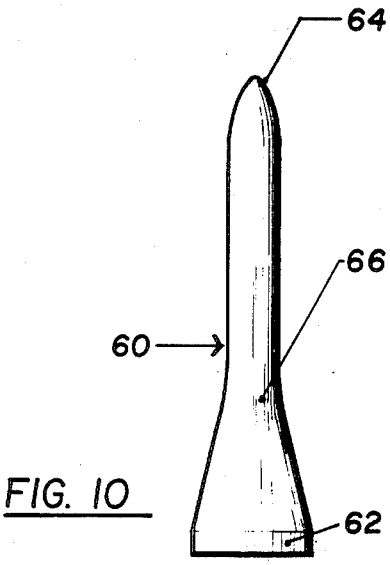
FIG. 10 shows a side elevation view of a playing piece representing a strategic nuclear weapon.

A playing piece 60, representing a strategic nuclear weapon, is shown in FIG. 10. Playing piece 60 has a substantially cylindrical base portion 62 which is connected to an upwardly pointing top portion, or "nose cone", 64 by a curvilinearly tapered central portion 66. Thus, playing piece 60 simulates a missile.

Figure 11:
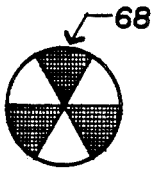
FIG. 11 illustrates a plan view of a total destruction marker for use in the board game of the present invention.
Figure 12:
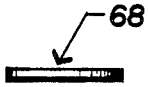
FIG. 12 is a side view of the total destruction marker shown in FIG. 11.

FIGS. 11 and 12 show a total destruction radiation marker or token 68 which is characterized in the preferred embodiment by a flat circular disc with a radiation or "target" symbol thereon.

Playing pieces 42, 44, 54 and 60 are active playing pieces which are placed on territories of central map portion 12 of game board 10, and are moved from territory to territory as a result of simulated military attacks, as hereinafter described. The shape and size of active playing pieces 42, 44, 54 and 60 define military capability indicia for the type of military capability of each active playing piece and the relative strength thereof. Total destruction marker 68 is a passive playing piece which, once placed on a territory of central map portion 12, is not moved for the remainder of the game, as is also hereinafter described. The playing pieces of each player are distinguished by color coding.

Figure 13:
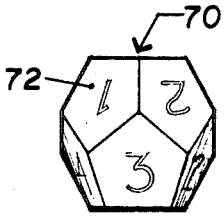
FIG. 13 shows a side view of a dodecahedron (twelve-sided) die utilized in the board game.

The outcome of some simulated military attacks is determined by chance means such as by comparing rolls of dice controlled by each of the players involved in the military attacks. In the preferred embodiment, but not by way of limitation, each player uses a dodecahedron die 70 such as illustrated in FIG. 13. Each facet 72 of die 70 has a unique number from one to twelve inscribed thereon. Obviously, normal six-sided dice, or other chance means, also could be utilized.

Figure 15:
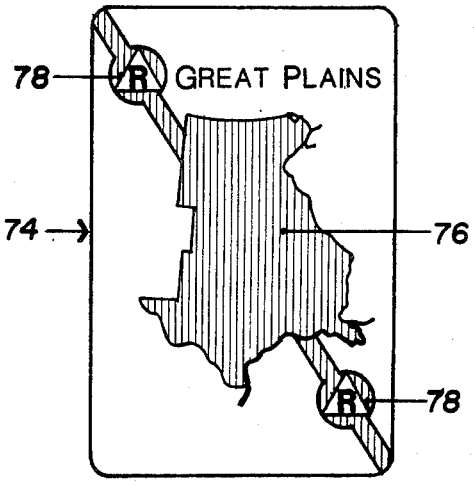
FIG. 15 illustrates a typical territory playing card used in the game.

The final portion of the apparatus of the board game of the present invention is a deck of playing cards. Included in the deck of cards are a plurality of territory cards and a plurality of power, or "wild", cards. A typical territory card 74, in this case representing Great Plains, is illustrated in FIG. 15. A central portion 76 of card 74 shows an outline of the territory represented. Each territory card 74 also has asset indicia 78 thereon corresponding to the respective asset indicia 34 on central map portion 12 of game board 10. Preferably, there is a single territory card 74 for each territory represented on central map portion 12.

Figure 14:
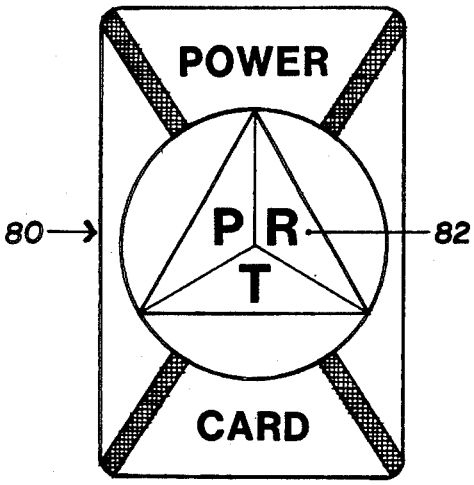
FIG. 14 shows a power, or "wild", card utilized in playing the board game of the present invention.

A power card 80 is illustrated in FIG. 14 as having a central portion 82 with indicia indicating all three assets of population, resources and technology. In the preferred embodiment, there are six power cards 80 included in the deck of playing cards, but the game is not limited to such a number.

Method of Play

The game is designed to be played by a plurality of players, preferably two to four, and the object of each player is to take control of all territories shown on central map portion 12 by means of simulated military attacks without destroying so many of the territories that the planetary surface is no longer considered habitable or for the surrender of opposing players. Each player has a plurality of active playing pieces 42, 44, 54 and 60, along with a plurality of passive playing pieces 68 for use during the game. No playing pieces are placed on central map portion 12 of game board 10 prior to start of the game.

In a first, or basic, method of play, the first player is determined by the highest roll of the dice, and players then take turns in clockwise order. The deck of playing cards is shuffled and six cards are dealt face down to each player, with the rest of the deck being placed face down. All players are allowed to place a playing piece 44, representing one conventional force or army, on each of the territories represented by the cards received. If a player receives a power card, he or she may deploy one conventional force playing piece 44 on any unclaimed territory of use it as a reinforcement on any territory he or she already controls.

After the initial dealing of cards and placement of conventional force playing pieces 44, actual play of the game begins. On each turn of play, a player goes through a Pre-Attack Mode and an Attack Mode. After completion of these modes, the player announces the end of his or her turn, and the turn of play of the next player begins. Play substantially continues in this manner for the duration of the game.

Pre-Attack Mode

A triad is defined as three playing cards all within the same continental power, or unique color group, having either a common asset indicia or three different asset indicia. In other words, a triad is formed by three territory cards 74, each of which has a single asset indicia of the group of population, resources or technology, or three territory cards which have one each of these three asset indicia. A power card 80 may be used to replace any asset indicia, so that two territory cards 74 and a power card may form a triad, and in fact, always will form a triad. However, only one power card per triad is allowed.

The first step in the Pre-Attack Mode is for the player to draw three new cards from the deck that no one else controls and to place a playing piece 44 on each territory represented by the territory cards 74 drawn. If a card is drawn for a territory already controlled by another player, the card must be surrendered to that other player. The drawing player then draws a replacement card 74. This procedure is repeated until a total of three new cards is in the player's hand. The next step is to place the cards representing triads, if any, face up in front of him. This procedure is referred to as "laying down triads". In the preferred embodiment of the game, a "balance of power" is maintained in that no player may have more than one triad more than any other player. This simulates the "Arms Race" where, due to time or financial restraints, espionage and other factors, no single world power has a clear superiority over other world powers.

The next step in the Pre-Attack Mode is to deploy triad military forces. The type and number of these triad forces is based upon the combinations of cards in the triads laid down by the player and also upon the other territories occupied by the player. The primary distinction is whether a continental power is incomplete or complete. A complete continental power is achieved when a single player occupies and controls every territory within that continental power. An incomplete continental power is any player's continental power which is not a complete continental power.

The triad military forces granted for incomplete continental powers are tactical weapons systems represented by playing pieces 54, deployable on the respective continental power as hereinafter described. The number of tactical weapons systems playing pieces 54 granted to the player is one for each incomplete triad.

Playing pieces 54 must be placed on one or more of the territories on central map portion 12 represented by one of the territory cards 74 that forms the triad laid down. If a triad is formed with a power card 80, playing pieces 54 may be placed on any territory in that continental power which the player already controls.

The procedure for determining the number of additional triad military forces for complete continental powers is different. If a triad for a complete continental power is formed by cards having a single asset indicia, additional triad military forces are awarded to the player in the same manner as for triads for incomplete continental powers; in other words, only tactical weapons systems playing pieces 54 are granted. However, if a player has a triad formed by cards having one each of the three asset indicia of population, resources and technology, the player is allowed to receive strategic nuclear weapons playing pieces 60. This simulates the real world asset combinations required to develop and build nuclear weapons. The number of strategic nuclear weapons playing pieces 60 granted for eligible triads of complete continental powers is one for each such triad. Territories with nuclear weapons playing pieces 60 thereon must also have at least one conventional force playing piece 44 as a simulated ground support force.

Obviously, a triad formed by cards having one each of the asset indicia is more desirable than a triad formed by cards representing a single asset indicia. Cards may not be substituted to change the type of triad originally laid down.

At the end of the Pre-Attack Mode, the player is allowed to deploy three conventional military playing pieces 44 per turn as simulated special forces. These special forces may be used to either claim unclaimed territories or to reinforce claimed territories. After the player has placed his or her special forces on the territories desired, the Attack Mode of the player's turn is ready to begin.

Attack Mode

During the Attack Mode of the player's turn, he or she may attack territories claimed and occupied by other player's. In the preferred embodiment, unclaimed territories may not be attacked. The attacks can be carried out in the form of conventional force attacks, tactical weapons system attacks and strategic nuclear weapon attacks.

Conventional military forces, represented by playing pieces 42 and 44, located on a territory of the attacking player may attack any adjacent territory occupied by an opposing player, or any territory occupied by an opposing player hereinafter defined as adjacent the attacking territory. Normally, the outcome of these attacks is determined by comparing the relative level of military strength between the attacking and attacked territories, and simply removing equal numbers of equal playing pieces from game board 10, The losses in the attacks are considered equal, so that the superior force wins. Once the forces on the attacked territory are totally removed, the territory then comes under the control of the attacking player. In doing so, the player must move at least one conventional force playing piece 44 to the newly conquered territory, and must also leave at least one conventional military force playing piece 44 on the attacking territory. It will thus be clear that an attacker must have at least two or more conventional force playing pieces 44 greater than the number on the attacked territory to conquer it. It should also be noted that the attacker can attack a territory even if he or she does not have this military supremacy, and thereby reduce the number of forces protecting the attacked territory.

An optional method of determining the outcome of conventional force attacks is to compare rolls of dice 70. The highest roll wins and the loser must remove one conventional force playing piece 44 from their respective territory.

Tactical weapons system playing pieces 54 may be used to attack any territory adjacent the attacking territory, or defined adjacent thereto, and further may be used to attack any territory within the same continental power, regardless of whether the attacking and attacked territories are adjacent. Thus, tactical weapons system playing pieces 54 give intracontinental attack capability. In the preferred embodiment, a tactical weapons system playing piece 54 is considered equivalent to three conventional force playing pieces 44 or one playing piece 42, and the outcome of the simulated tactical attacks is the same as hereinbefore described for conventional force attacks.

Whenever a territory is conquered through conventional force or tactical weapons system attack, the territory card 74 corresponding to that attacked territory must be given to the conquering player. This is true, even if the card representing the attacked and defeated territory is used by the defeated player as part of one of his or her laid-down triads. Such an attack destroys the triad, and the attacked player must place the remaining two cards in his or her hand or replace the removed card with a card 74 having the same asset or power card 80.

Attacks utilizing strategic nuclear weapon playing pieces 60 may occur any time during the game. When a territory is attacked by a strategic nuclear weapon playing piece 60 and is not defended by a similar playing piece as hereinafter described, the territory sustains total destruction. All of the defending military forces are removed from that territory, and the attacking player places a total destruction marker 68 thereon. A territory which sustains such nuclear attack is considered dead and unusable for the remainder of the game. The territory card 74 representing the dead territory is placed in a separate stack of cards and not used again.

If a strategic nuclear weapons playing piece 60 is used to attack a territory with a similar playing piece thereon, the playing pieces simply cancel each other out, and the attacked territory is not destroyed.

A strategic nuclear weapon playing piece 60 may not be used to attack any territory represented by a card in a triad laid down by any opposing player unless there are no other non-triad territories left to attack. This simulates a built-in defense system for all triads until only territories forming triads are left.

Conventional military forces, represented by playing pieces 42 and 44, and tactical weapons systems, represented by playing pieces 54, may not attack any territory which has a strategic nuclear weapon playing piece 60 thereon.

Once the player has made all of the simulated military attacks that he or she desires in that turn, he or she so announces, and the next player's turn begins.

Succeeding players follow the same procedure for each turn. The end of the game is defined as the point at which all players but one have been eliminated from the game, and the surviving player controls all territories still functioning, that is, all territories except those which have a total destruction marker 68 placed thereon, or when all opposing players are technically defeated because they are incapable of producing any working triads.

Alternate Method Of Play

An alternate method of play is provided for more advanced players with experience in playing the previously described basic method. In this advanced embodiment, the play of the game is the same as the first, or basic, method except as follows:

Pre-Attack Mode Variations

In the advanced method of play, rather than simply awarding one tactical weapons systems playing piece 54 for each incomplete triad, the following system, summarized in weapons procurement chart 22, applies. The first triad laid down receives one tactical weapons systems playing piece 54; the second triad laid down receives two additional tactical weapons systems playing pieces 54; the third triad laid down receives three additional tactical weapons systems playing pieces 54, and so on. In other words, if a player has two triads for an incomplete continental power or one triad for each of two incomplete continental powers, that player receives a total of three tactical weapons systems playing pieces. If a player has three incomplete triads, the player receives six tactical weapons systems playing pieces 54.

These pieces are placed on the territories in a manner similar to those in the basic method of play. A player may define at any time the order in which his or her triads were laid down so that he or she can determine on each turn how the tactical weapons systems playing pieces 54 are to be deployed.

Similarly, the number of strategic nuclear weapons playing pieces 60 granted for eligible triads of complete continental powers varies from that of the basic method of play. In the advanced method, the first complete continental power triad receives one strategic nuclear weapons playing piece 60; the second triad receives two additional strategic nuclear weapons playing pieces 60; the third triad receives three additional strategic nuclear weapons playing pieces 60, and so on. This is also summarized in weapons procurement chart 22. Again, a player may define at any time the order in which his or her triads are laid down so that he or she can determine on each turn how the strategic nuclear weapons playing pieces 64 are to be deployed on the respective territories.

A final variation in the Pre-Attack Mode of the advanced method of play is a limitation on the number of power cards that a player may possess at any time, both in his or her hand or in triads laid down. The maximum number of such power cards is equal to the maximum number of triads that any player has laid down at that time. It a player draws more power cards than this limit allows, he or she must draw new replacement cards and return the extra power cards to the top of the deck. As always, the player is allowed to place a conventional force playing piece 44 on the territory represented by any new cards drawn. Note that this limitation means that a player may not receive more than one power card at the initial deal of cards because no one is eligible to lay down more than one triad at that time.

Attack Mode Variations

In the attack mode of the advanced method of play, any strategic nuclear weapon playing piece 60 within an attacked continental power or adjacent red dot territory may intercept and destroy an attacking strategic nuclear playing piece. Thus, the game provides simulated anti-ballistic missiles.

Also, in the Attack Mode of the advanced method of play, use of strategic nuclear weapons playing pieces has a variable result. As a simulation of an electromagnetic pulse, or EMP, effect, which is theorized could cause missiles to go off target, the result of an attack by a strategic nuclear weapons playing piece 60 in the game of the present invention is determined by a roll of the attacking player's die. A preferred embodiment of this simulated EMP effect is shown in the following table which lists various results corresponding to particular rolls of the die, but the game is not limited to this particular configuration:

| Die Roll | Results |
|---|---|
| 1-2 | Attacking player loses strategic nuclear weapons playing piece 60; no effect on any territory. |
| 3-4 | Strategic nuclear weapons playing piece destroys any territory of the defending player's choice adjacent the attacked territory. |
| 5-6 | Strategic nuclear weapons playing piece destroys any territory of the attacking player's choice adjacent the target territory. |
| 7-12 | Strategic nuclear weapons playing piece destroys original target territory; no EMP effect |

For the purposes of the above variation in results, territories already destroyed by strategic nuclear weapons playing pieces 60 may still be considered as eligible adjacent territories.

Defense Mode

After the attacks are completed in the advanced game, the player receives reinforcements in the form of conventional force playing pieces 44 based on complete continental powers that he or she controls after the Attack Mode. In the preferred embodiment, but not by way of limitation, the number of playing pieces 44 is as follows:

North America—Six reinforcements
Europe—Five reinforcements
Africa—Four reinforcements
Far East—Five reinforcements
West Pacific—Four reinforcements
South America—Four reinforcements
Middle East—Four reinforcements
USSR—Six reinforcements The reinforcement conventional force playing pieces 44 must be placed on territories of the continental powers from which they were awarded.

After deployment of the reinforcements, all active playing pieces 42, 44, 54 and 60 may be relocated, or redeployed, to adjacent territories anywhere on central map portion 12. Any of these active playing pieces must follow a direct line through adjacent territories, or through territories defined to be adjacent as hereinbefore described, but such redeployed playing pieces may never cross an opponent's territory or a territory which has a total destruction marker 68 placed thereon. At least one conventional force playing piece 44 must remain on each territory which was previously occupied.

Countdown Timetable

A countdown timetable on game board 10, indicated by reference numeral 28 in FIG. 1, is utilized throughout play of the advanced version. Timetable 28 is divided into a plurality of boxes, each of which defines a time period in world history and future. After each player completes a turn a timetable marker (not shown) is moved to a successive time period on the countdown timetable. In the preferred embodiment, but not by way of limitation, the time periods in countdown timetable 28 are progressively later in time and are as follows:

Start
1945–1960
1961–1976
1977–1982
1983–1988
1989–1993
January through July, 1994
Aug. 1, 1994
Aug. 2, 1994
Aug. 3, 1994
The morning of Aug. 4, 1994
12:00 noon on Aug. 4, 1994
1:00 p.m. on Aug. 4, 1994
1:30 p.m. on Aug. 4, 1994
2:00 p.m. on Aug. 4, 1994
2:15 p.m. on Aug. 4, 1994
2:30 p.m. on Aug. 4, 1994
2:45 p.m. on Aug. 4, 1994
3:00 p.m. on Aug. 4, 1994
End As can be seen, countdown timetable 28 has an initial time period of sixteen years, and the time periods get progressively shorter with the last few representing only fifteen-minute increments. The object is to simulate the feeling that time is running out as worldwide tensions increase and because there is less use of conventional forces with a corresponding increase in use of "fast response" nuclear missiles. Once the marker is moved to the box indicated as "End", all players simultaneously receive all strategic nuclear weapon playing pieces 60 that they would normally be allowed on their next turn. Starting with the first player, all players must then launch all strategic nuclear weapon playing pieces 60 at any territories which are eligible targets on central map portion 12. Thus, strategic nuclear attacks automatically occur after a predetermined number of turns of play.

Damage indicia in the form of result table 30 on game board 10, is shown in FIG. 1. A plurality of classes of victories are listed in result table 30 which are determined by the number of territories which have sustained a simulated nuclear attack by a strategic nuclear weapon playing piece 60, that is, those totally destroyed and having a total destruction marker 68 thereon. Advanced players attempt global domination while keeping damage levels to a minimum.

These classes include a plurality of survival conditions and a non-survival condition defined as follows:

Survival Conditions

Class Victory 1—declared when one to ten territories have sustained total destruction by a simulated strategic nuclear attack; the damage level is considered light.

Class Victory 2—defined when eleven to twenty territories have sustained total destruction; the damage level is defined as medium.

Class Victory 3—occurs when twenty-one to thirty territories have sustained total destruction; the damage level is defined as heavy.

Class Victory 4—occurs when thirty-one to thirty-five territories have sustained total destruction; the damage level is defined to be critical; if two or more players are still surviving, the game is considered to be a tie between those players.

Non-Survival Conditions

Class Victory 0—occurs when thirty-six or more territories have sustained total destruction; the damage level is defined to be total and catastrophic; all players lose the game.

In the advanced embodiment, no simulated attacks may be carried out by strategic nuclear weapons playing pieces 60 on any territories until at least one player has laid down three triads.

If, during the Pre-Attack Mode of a player's turn, that player draws a territory card 74 from the deck of playing cards corresponding to a territory occupied by an active playing piece of another player, the player drawing the territory card is allowed to place a conventional force playing piece 44 on that territory. At this point, the player may also deploy on that territory any of all of the three simulated special forces normally obtained during the Pre-Attack Mode. Thus, it will be seen that up to four defending conventional force playing pieces 44 may be destroyed. The outcome of this simulated attack may be determined in any of the ways hereinbefore described for the basic method of play. If the disputed territory is defended by a strategic nuclear weapon playing piece 60, the attacking playing piece 44 automatically loses, and the territory card 74 must be given to the defending player. The territory card 74 representing a territory thus in dispute may not be laid down as part of a new triad until one player totally controls the territory.

Naval Forces

Another significant difference between the basic method of play hereinbefore described, and the alternate advanced embodiment is the use of naval forces. As previously mentioned, territories having a red dot 38 or a blue dot 40 thereon may function as naval ports and may attack, and may be attacked by, naval fleets. During the redeployment of forces in the Defense Mode of a player's turn, the player may move any active playing piece 42, 44, 54 or 60 into a naval fleet area 32 from any bordering territory occupied by his or her playing pieces having a red dot 38 or a blue dot 40 thereon. However, a player may not use these naval forces to attack territories occupied by opposing players in the same turn. The player must wait until his or her next turn to utilize this naval force capability.

Simulated military attacks on naval fleets from eligible territories, and attacks by naval fleets on eligible territories, are carried out in the same manner as the land attacks hereinbefore described. The only distinction is that the playing pieces of more than one player may occupy an ocean at any time, and do not automatically come into conflict. A defending ocean fleet must be completely destroyed before any attacking forces may advance and attack a territory having a red dot 38 or a blue dot 40 thereon. As with land attacks, at least one conventional playing piece 44 must remain in the naval fleet area 32 and may not advance with the other forces. In addition, the attacking fleets may not advance inland further than the territory originally attacked until the player's following turn.

An attack by a strategic nuclear weapon playing piece 60 on naval fleet area 32 will destroy all forces within that naval fleet area including any forces of the attacking player. However, unlike a territory so attacked, the ocean itself is not destroyed and forces may be deployed into that naval fleet area 32. A naval fleet may not be attacked by conventional or tactical forces if defended by a strategic nuclear playing piece 60, and any nuclear attack on a naval fleet area 32 having a strategic nuclear weapon playing piece included therein will only cancel out the playing piece 60 involved and will not affect any other playing piece in that naval fleet area. In other words, the strategic nuclear weapons playing piece 60 in naval fleet area 32 acts as an antiballistic missile for an attacking strategic nuclear playing piece.

Once a player has announced an attack on a territory controlled by an opposing player, the player being attacked may retreat and withdraw all but one conventional force playing piece 44 from the attacked territory. Such retreat may not take place prior to an announced attack.

It can be seen, therefore, that the global domination board game of the present invention is well adapted to carry out the objects and attain the ends and advantages mentioned, as well as those inherent therein. While a presently preferred embodiment of the apparatus of the invention and two presently preferred embodiments of methods of play have been described for the purposes of this disclosure, numerous changes in the construction and the arrangement of the parts of the apparatus and numerous changes in the methods and rules of play can be made by those skilled in the art. All such changes are encompassed within the scope and spirit of the invention as defined by the appended claims.

What is claimed is:

1. A game apparatus for use in playing a game by a plurality of players, comprising:

a game board comprising:

a map portion depicting a planetary surface having continental land masses thereon with bodies of water adjacent thereto, each of said continental land masses being divided into a plurality of territories, which territories are acquired and occupied by said players of said game and subject to attack by opposing players;

border indicia for indicating adjacent territories and paths of attack between said territories, said border indicia including:

common borders between said territories;

constructive borders between spaced territories; and constructive borders between continental land masses; and asset indicia for indicating one of a plurality of assets for each of said territories, said plurality of assets including population, resources and technology; a deck of playing cards comprising:

an individual territory card for each of said territories depicted on said map portion of said game board; and at least one wild card substitutable for any of said territory cards;

a plurality of active playing pieces having military capability indicia for indicating that each of said pieces represents one of a plurality of military capabilities, said plurality of military capabilities comprising conventional forces, tactical weapons and strategic nuclear weapons, whereby said active playing pieces are placeable and movable, individually and in combination, on said map for indicating respective occupation of said territories by said players and for simulating military attacks between territories occupied by opposing players;

a plurality of passive playing pieces placeable on at least some of said territories subjected to a simulated attack by an active playing piece representing a strategic nuclear weapon, said passive playing pieces indicating total destruction of said territory subjected to said attack and further indicating nonuse of said territory throughout the remainder of a game; and damage indicating means for indicating a level of damage after said simulated military attacks.

2. The game apparatus of claim 1 further comprising chance means for randomly determining an outcome of at least some of said simulated military attacks.

3. The game apparatus of claim 2 wherein said chance means is characterized by a plurality of dodecahedron dice.

4. The game apparatus of claim 1 wherein said military capability indicia are characterized by distinguishable shapes for said active playing pieces.

5. The game apparatus of claim 1 wherein said map further depicts naval fleet deployment areas in said bodies of water and said border indicia includes ocean borders, whereby said active playing pieces are placeable and movable, individually and in combination, in said fleet areas for indicating respective occupation of said fleet areas by said players, for simulating military attacks between said fleet areas occupied by opposing players, and for simulating military attacks between said fleet areas and at least some of said territories occupied by opposing players along said ocean borders.

6. The game apparatus of claim 1 further comprising time-keeping means for indicating a simulated relative time period for successive turns of play by said players of said game.

7. The game apparatus of claim 6 wherein said time-keeping means simulates time periods of progressively shorter duration for said successive turns of play.

8. A game apparatus comprising:

a plurality of movable playing pieces; and a game board comprising:

a central map portion depicting a planetary surface comprising a plurality of land masses thereon, each of said land masses being divided into a plurality of territories, and whereon players of said game may place and move said playing pieces;

land mass indicia for identifying and distinguishing said land masses;

territorial indicia for identifying and distinguishing said territories; border indicia for indicating adjacent territories and paths of attack between said territories, said border indicia including: common borders between said territories: constructive borders between spaced territories; and constructive borders between continental land masses;

territorial asset indicia for indicating one of a plurality of assets as a primary asset for each of said territories, whereby combinations of said assets determine a quantity and relative strength of at least some of said playing pieces;

a border surrounding said central map portion, said border comprising play action indicia for indicating proper play action followed by players playing said game; and damage indicia for indicating a non-survival condition in which all players lose and a plurality of survival conditions dependent upon results of said simulated military attacks.

9. The game apparatus of claim 8 wherein said land mass indicia comprises a distinguishable color for each of said land masses on said map portion.

10. The game apparatus of claim 8 wherein said planetary surface further comprises a plurality of bodies of water adjacent at least some of said land masses.

11. The game apparatus of claim 8 further comprising time indicia for indicating simulated relative time periods for successive turns of play by said players in said game.

12. The game apparatus of claim 11 wherein said simulated relative time periods are of progressively shorter duration for said successive turns of play.

13. A game apparatus for use in a game played in successive turns by a plurality of players, comprising:

a game board comprising:

a map depicting a planetary surface comprising a plurality of geographical areas thereon, each of said geographical areas including a plurality of geographical subdivisions;

indicia for indicating paths of attack between geographical subdivisions on said mape and including:

common borders between contiguous geographical subdivisions;

constructive borders between spaced geographical subdivisions of a common geographical area; and dots indicating paths of attack between geographical subdivisions of different geographical areas; and asset indicia for indicating assets on said map whereby each of said geographical subdivisions is indicated to have at least one of said assets; a deck of playing cards comprising:

an individual geographical subdivision card for each of said geographical subdivisions depicted on said map; and at least one wild card substitutable for any of said geographical subdivision cards;

a plurality of playing pieces placeable and movable, individually and in combination, on said game board for indicating respective control of said geographical subdivisions by said plurality of players and for simulating military attacks between geographical subdivisions controlled by opposing players, each of said playing pieces having military capability indicia for indicating one of a plurality of military capabilities including conventional military forces capable of simulated military attacks along said paths of attack between geographical subdivisions, tactical weapons capable of simulated military attacks along said paths of attack between geographical subdivisions and on any geographical subdivision in a single geographical area, and strategic nuclear weapons capable of military attacks on any geographical subdivision; and time-keeping means for indicating a simulated relative time period of progressively shorter duration for successive turns of play for simulating the feeling that time is running out as worldwide tension is increased.

14. The game apparatus of claim 13 further comprising chance means for randomly determining an outcome for at least some of said military attacks.

15. The game apparatus of claim 13 wherein:

said plurality of geographical areas comprises:

a plurality of land masses; and a plurality of bodies of water adjacent at least some of said land masses; and said indicia for indicating paths of attack further includes dots for indicating geographical subdivisions subject to attack from playing pieces positioned in said bodies of water.

16. The game apparatus of claim 15 wherein:

said planetary surface is characterized as that of planet Earth;

said land masses are characterized as continents of planet Earth; and said bodies of water are characterized as oceans and seas of planet Earth.

17. The game apparatus of claim 13 wherein said asset indicia comprise the assets of population, resources and technology.

18. The game apparatus of claim 13 further comprising a plurality of total destruction markers placeable on said map for indicating total destruction of at least some of said geographical subdivisions subjected to a simulated military attack by a playing piece indicating a strategic nuclear weapon and for indicating all playing pieces of any opposing player in such geographical subdivisions are destroyed and that any geographical subdivision subjected to such a simulated military attack by a playing piece indicating a strategic nuclear weapon is not usable by any player throughout the remainder of said game.

19. The game apparatus of claim 13 further comprising damage indicia on said game board for indicating a plurality of classes of victories which are determined by the number of geographical subdivisions subjected to a simulated military attack by a playing piece indicating a strategic nuclear weapon, said classes of victories indicated comprising:

at least one survival condition wherein at least one player is declared a victor of said game; and a non-survival condition wherein all players are declared losers of said game.

20. A game apparatus comprising:

a plurality of playing pieces representing conventional military forces;

a plurality of playing pieces representing tactical military weapons;

a plurality of playing pieces representing strategic nuclear weapons;

a game board comprising:

a central playing surface adapted for receiving said playing pieces, said playing surface comprising:

a map depicting a polar view of a plurality of continental groups thereon including North America, South America, Europe, Africa, USSR, Middle East, Far East and West Pacific, each of said continental groups being divided into a plurality of territories, and further indicating a plurality of bodies of water thereon including Atlantic Ocean, Indian Ocean, Pacific Ocean and Mediterranean Sea, said territories being acquired by players of a game during successive turns of play and occupied by playing pieces of said players; and border indicia for indicating borders between said territories and further indicating paths of attack for at least some simulated military attacks between opposing playing pieces carried out on said map, said border indicia including common borders between contiguous territories, constructive borders between territories separated by bodies of water, dots indicating paths of attack between territories of different continental groups, and dots indicating paths between said bodies of water and at least some of said territories;

asset indicia indicating a single asset for each of said territories from a group of assets including population, resources and technology;

a countdown time table spaced outwardly away from said central map portion for indicating time periods of progressive shorter duration for successive turns of play, said countdown time table indicating a maximum predetermined number of turns of play for a game at which point all playing pieces representing strategic nuclear weapons must be used in simulated military attacks;

a result table spaced outwardly away from said central map portion for indicating at least one survival condition wherein at least one player is a victor of said game and a non-survival condition indicating that all players are losers of said game if a predetermined number of territories subjected to a simulated military attack by playing pieces representing strategic nuclear weapons is exceeded; and a plurality of total destruction markers for placement on said territories subjected to simulated military attacks by playing pieces representing strategic nuclear weapons, said marker indicating total destruction of all playing pieces in such territories and further indicating such territories are no longer usable in any way by any player throughout the remainder of said game;

a deck of playing cards comprising:

an individual territory card for each of said territories indicated on said central map portion, each territory card having the same asset indicated thereon as is indicated for the corresponding territory on said central map portion;

at least one wild card substitutable for any of said territory cards;

wherein, said cards are acquired by players of said game through successive turns of play and combinations of said cards determining quantities and types of said playing pieces which are acquirable and deployable by players of said game, cards in a single continental group representing each of said asset indicia being required for acquiring playing pieces representing strategic nuclear weapons.

* * * * *